US009724700B2

(12) United States Patent
Farr

(10) Patent No.: US 9,724,700 B2
(45) Date of Patent: Aug. 8, 2017

(54) ROTARY COLLIDER AIR MILL

(71) Applicant: Reyndol Pat Farr, Richland Hills, TX (US)

(72) Inventor: Reyndol Pat Farr, Richland Hills, TX (US)

(73) Assignee: FarrBrown Holding LLC, Bedford, TX (US)

( * ) Notice: Subject to any disclaimer, the term of this patent is extended or adjusted under 35 U.S.C. 154(b) by 0 days.

(21) Appl. No.: 14/544,537

(22) Filed: Jan. 16, 2015

(65) Prior Publication Data

US 2015/0202631 A1 Jul. 23, 2015

Related U.S. Application Data

(60) Provisional application No. 61/965,078, filed on Jan. 16, 2015.

(51) Int. Cl.
*B02C 13/12* (2006.01)
*B02C 13/04* (2006.01)

(52) U.S. Cl.
CPC ..... *B02C 13/12* (2013.01); *B02C 13/04* (2013.01)

(58) Field of Classification Search
CPC ..... B02C 19/06; B02C 13/12; B02C 13/04
USPC ..... 241/57, 275, 188.1, 189.1
See application file for complete search history.

(56) References Cited

U.S. PATENT DOCUMENTS

| | | | | |
|---|---|---|---|---|
| 1,424,225 | A | 8/1922 | Williams | |
| 3,333,777 | A | 8/1967 | Highfill, Jr. et al. | |
| 4,077,574 | A | 3/1978 | Francis | |
| 4,151,959 | A | 5/1979 | Deister | |
| 4,274,601 | A | 6/1981 | Musto | |
| 5,178,335 | A | 1/1993 | Mertens | |
| 5,368,243 | A | 11/1994 | Gold | |
| 5,425,507 | A | 6/1995 | Stumpff | |
| 2009/0206186 | A1* | 8/2009 | Morrison | B01D 21/06 241/24.16 |

* cited by examiner

*Primary Examiner* — Mark Rosenbaum
(74) *Attorney, Agent, or Firm* — Arthur J. Brady

(57) ABSTRACT

A rotary collider air mill apparatus that uses accelerated air moving at high velocities as the primary reduction medium is described. The apparatus produces turbulent air currents and shear waves within a polygonal housing whereby solid particles introduced into the housing repeatedly collide with each other and are fractured into smaller particles. An exemplary rotary collider air mill apparatus may include a polygonal housing having a front plate and a back plate and 5 or more side plates, a drive shaft passing through the central portion of the polygonal housing, a sprocket mounted on the drive shaft and having arms extending radially from a central hub, and 3 or more blade sections attached to the arms. The rotary collider air mill apparatus is scalable upward or downward in sizes ranging between 12 inches and 144 inches in diameter with the housing and internal mechanisms sized proportional to one another.

15 Claims, 4 Drawing Sheets

ROTARY COLLIDER AIR MILL

CROSS-REFERENCE TO RELATED APPLICATIONS

This application claims priority to U.S. Provisional Patent Application No. 61/965,078 entitled "Rotary Collider Air Mill" and filed on Jan. 22, 2014. The provisional application is hereby incorporated in its entirety by specific reference thereto.

TECHNICAL FIELD

The present invention relates to a mill for crushing stone, minerals and other materials that may be fractured. More specifically, the present invention relates to a form of rotary mill which uses high speed air as a medium to cause various materials to be broken down into smaller pieces by repeatedly colliding into each other

BACKGROUND

There is a need for machinery suitable for crushing stone, minerals and other materials that may be fractured. There is also a need for a rotary mill that can fracture hard materials by colliding the input materials into each other repeatedly to break them into successively smaller and smaller pieces. Many rock crushing and breaking machines in use today rely upon the action of hardened steel to smash and pulverize rocks and minerals into smaller pieces. These machines can achieve a particle size reduction, but these machines are subject to a great deal of wear and tear in the course of normal operation.

Rock crushing machines are further limited in the size of particles that may be input and subsequently reduced to only a certain fraction of the previous particle size at the output. Using typical rock crushing machines, to reduce rock pieces of about 2 inches in diameter (about 500 mm) into a very fine powder having particles sizes which are less than 0.002 inches in diameter (about 0.5 mm), it would be necessary to process this material in a series of steps moving from one machine to another and requiring a considerable amount of processing time and additional handling.

Accordingly, there is a need for machinery for crushing or milling stone, minerals and other materials into very small particles or fine powders. It is further desired to produce a mill that can reduce input materials to approximately 1/1000 of the original size in just a single processing step. It would also be desired to create a mill that utilizes air circulating at high speed as a primary medium by which input material is crushed without causing undue wear and tear on the mill itself, thereby greatly reducing the frequency with which parts are replaced. There is also a desire to produce such a mill that is completely scaleable in size, both upward and downward, to better accommodate lager and smaller input materials by keeping the component parts of the mill sized proportionally to one another.

SUMMARY

The rotary collider air mill of the present invention is generally intended for application to rock, mineral or other materials that may be fractured by forcing the input materials to into a series of collisions. In short, the air mill of the present invention will create high velocity chaotic air currents within an enclosure that will force input materials to repeatedly collide with each other at very high speeds and cause the input materials to fracture into smaller and smaller pieces. In some embodiments the rotary collider air mill may be utilized in to produce cosmetic powders, food spices, building products, metallurgical products, plastic fillers and a number of other items.

In a number of exemplary embodiments of the present invention a rotary collider air mill comprising a polygonal housing having at least 5 sides, a sprocket having at least 3 blades attached thereto, a drive shaft for rotating the sprocket at high speeds, an input port and an output port is disclosed. In one embodiment of the present invention the apparatus of the present invention will be fully scalable upward or downward in volume by resizing the polygonal housing, the sprocket, and the blades proportionally to each other. By way of example only, the internal mechanisms of the sprocket and the attached arms may rotate through a space that has a diameter of 12, 18, 24, 48, 60, 96 or even 144 inches across by scaling the housing and internal mechanisms upward or downward proportionally to each other to preserve operational functionality.

In another embodiment of the present invention the rotary collider air mill will use high velocity chaotic air as a medium to repeatedly smash input materials into each other in a series of collisions to fracture the input materials into smaller and smaller pieces. In yet another embodiment of the present invention the apparatus will be capable of moving air at speeds in the transonic range of about 600 to 768 miles per hour (mph) and approaching the speed of sound. In a further embodiment of the present invention the rotary air collider mill will be able to reduce input materials to about 1/1000 of the original size in a single processing step.

By way of example only, the apparatus of the present invention may reduce input materials of about 1 to 2 inches in size to a fine powder of less than about 0.001 inches in size, a significant portion of which may be passed through a #200 mesh screen, particles having sizes of less than about 100 microns. The apparatus of the present invention represents a significant improvement and advance in technology over the existing ball mills, hammer mills, roller mills and jet mills now in use.

BRIEF DESCRIPTION OF THE DRAWINGS

The present invention will be better understood in view of the detailed description in conjunction with the following figures and in which.

DETAILED DESCRIPTION

Figure 1:
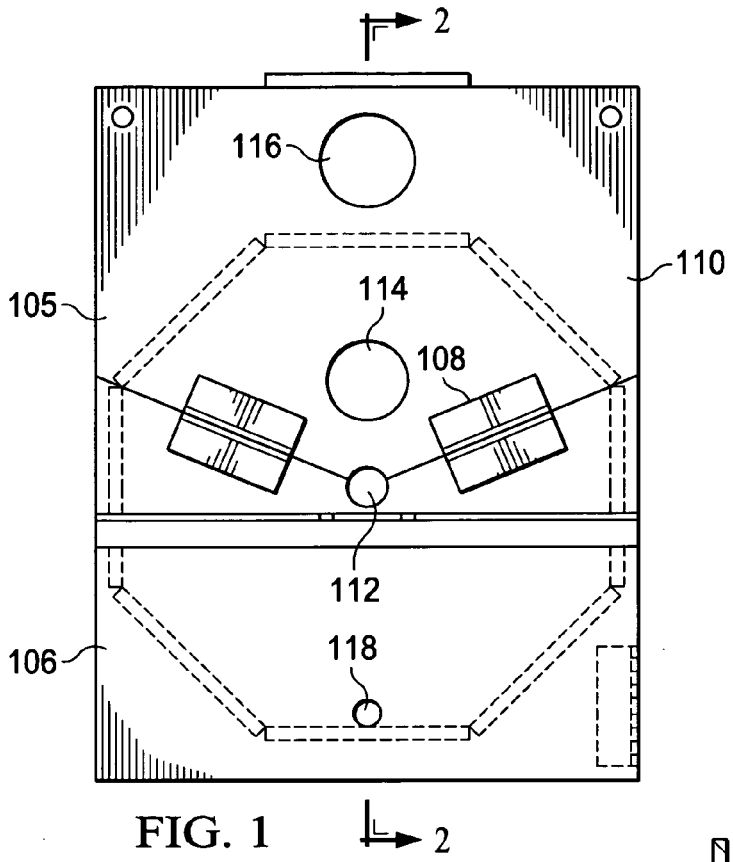
FIG. 1 is a front elevation view of the rotary air collider mill.

In one embodiment, the rotary air collider mill is an apparatus comprising a polygonal housing having at least 5 sides, a sprocket having at least 3 blades attached thereto, a drive shaft for rotating the sprocket at high speeds, an input port and an output port. These components should be precisely machined and sized proportionately to each other, but may be scaled up or down in size so long as the proportions of these components are preserved relative to one another. By way of example only, it will be possible to construct an apparatus in accordance with the present invention in which the sprocket and attached blades sweep through a diameter of about 12, 18, 24, 48, 60, 96 or 144 inches so long as the housing, sprocket, blades, drive shaft, input port and output port are all sized proportionately to each other.

One component of the rotary air collider mill is polygonal housing having at least 5 sides. The polygonal housing should be constructed of steel or similar materials that are particularly hard, durable and not brittle across a wide range of operating temperatures. The polygonal housing-should have a front plate, a back plate and at least 5 side panels. The front plate and the back plate should be placed vertically and positioned parallel to each other with the at least 5 side panels defining an enclosed volume between them. The at least 5 side panels may define a symmetrical or asymmetrical polygonal housing. By way of example only, it is possible to form useful housings for the present invention having 6, 8, 10, 12 or more side panels disposed between the front plate and the back plate.

In one embodiment of the present invention, it is possible to form a housing having 8 equally sized side plates to form a regular and symmetrical octagonal housing. This embodiment would have a cut away profile that resembles a typical "stop sign" shape that is familiar to all drivers as a traffic control device. Note that while the number of sides may vary the polygonal chamber should be oriented such that the bottom most portion is a flat side panel rather than a joint between two sides. This is intended to ensure that the rotating sprocket and attached blades will completely sweep the bottom of the apparatus when rotated and avoid an accumulation of rock or mineral debris at the bottom of the housing. The accumulation of rock or mineral debris within the housing would require cleaning and removal to prevent damage to the apparatus and could be rather time consuming.

By way of example only, a suitable housing for a rotary collider air mill with a 48 inch diameter and a regular octagonal chamber will now be described herein in some detail. Referring now to both FIGS. 1 and 2, the polygonal housing 100 should have a front plate 110 and a back plate 120 each formed of steel or similar materials. These plates should be not less than about ½ inch thick and preferably about 1 inch thick to ensure durability. Similarly, to form a regular octagonal model, the housing should have 8 equally sized side panels 131-138 about 1 inch thick also formed of steel or similar materials.

Figure 2:
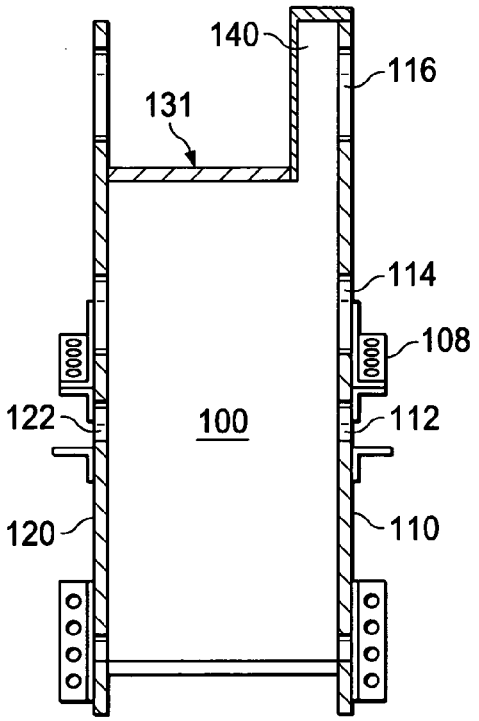
FIG. 2 is a left side cross sectional view of the rotary air collider mill.

Still referring to both FIGS. 1 and 2, the front plate 110 and the back plate 120 should each measure about 60 inches high by about 55 inches wide by about 1 inch thick. The eight equally sized side plates 131-138 should be about 20 inches long by about 24.5 inches wide and about 1 inch thick. The front plate 110 and the back plate 120 should be positioned vertically and parallel to each other and spaced about 24.5 inches apart. The side plates 131-138 should be placed between and perpendicular to the front plate 110 and the back plate 120 and should form 45 degree angles to each other between adjacent side panels. The front plate 110, back plate 120 and 8 side plates 131-138 should be securely attached to each other by various mechanical means, including mechanical fasteners, but most preferably by welding to permanently attach these pieces to each other. In one alternative embodiment, not shown, the front plate 110 and the back plate 120 may be slotted to allow tabs to be extended from the edges of the 8 side panels 131-138 and inserted into the small slotted openings in the front plate 110 and the back plate 120 to allow a sort of tongue and groove configuration for added strength and stability.

As shown in FIG. 1, the housing may be bisected near the midpoint into an upper half 105 and lower half 106. By sectioning the housing 100 into an upper half 105 and a lower half 106, it will be a relatively easily to open the housing 100 for servicing or cleaning. As shown in FIG. 2, the upper housing 105 and the lower housing 106 may have a number of flanges 108 attached to the exterior of the housing 100 and use a number of nut and bolt type fasteners to hold the upper housing 105 and the lower housing 106 securely in place during operation of the rotary air collider mill.

Still referring to FIGS. 1 and 2, the front plate 110 and the back plate 120 each have a number of openings or ports cut into them. The back plate has a centrally located opening 122 of about 4 inches in diameter to accommodate the drive shaft, not shown here. The front plate 110 has a centrally located opening 112 of about 4 inches in diameter to accommodate the drive shaft as well, but also features an input port 114 of about 8 inches in diameter to receive the input materials and guide them into the mill and an exhaust port 116 of about 10 inches in diameter to allow the processed rock or mineral powder to be removed from the mill. The sizing or location of the input port 114 and the exhaust port 116 may be changed somewhat depending on the size of the materials to be milled. As shown in FIG. 1, the front plate 110 may also have a cleaning or inspection port 118 of about 3 inches in diameter located near the bottom of the housing 100.

It is critical that the input port 114 be located within the 24 inch radius defined by the rotation of the sprocket and attached blades, not shown here, minus the displacement of the blades themselves. In short, the input port 114 must be located between the outer radius of the drive shaft (about 2 inches from center) and the innermost radius defined by the moving blades (about 22 inches from center). As shown in FIG. 1, the input port 114 is located about 11 inches from the center of the front plate 110. Similarly, it is critical that the exhaust port 116 be located outside the 24 inch radius defined by the sprocket and attached blades, not shown. In operation, the mill will tend to produce a negative air pressure or partial vacuum within the approximately 22 inch inner radius defined by the moving blades, and a positive air pressure outside the approximately 24 inch outer radius defined by the moving blades. The negative air pressure created near the input port 114 will be used to draw materials into or feed the mill, and the positive air pressure near the exhaust port 116 will be used to expel or push the processed powder out of the mill. Note that the difference between the outer radius and the inner radius defined by the moving blades will be referred to as the displacement of the blades.

Referring now to FIG. 2, in one embodiment of the rotary air collider mill, the exhaust port 116 may be located completely outside of housing 100 by incorporating an exhaust chamber 140 into the design. By creating an opening in the uppermost plate 131 of the housing 100 it is possible to vent the crushed rock powder, not shown, from the housing 100 into the exhaust chamber 140 and out through the exhaust port 116 in the front plate 110.

Figure 3:
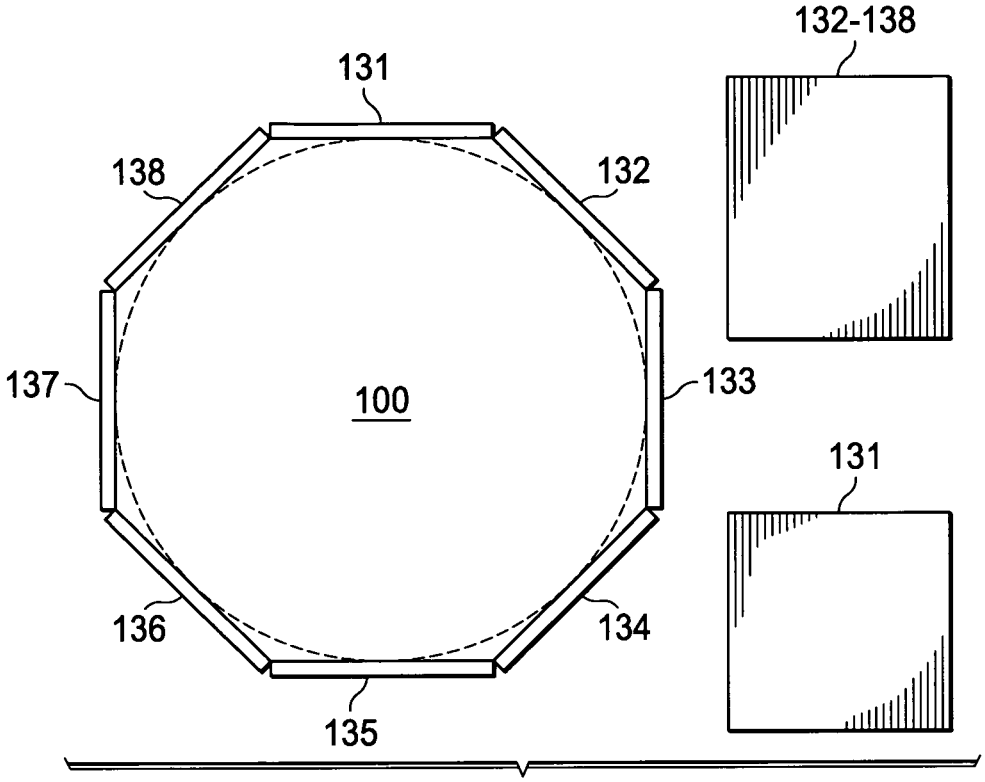
FIG. 3 is a front elevation view of a regular octagonal housing for the rotary air collider mill.
Figure 4:
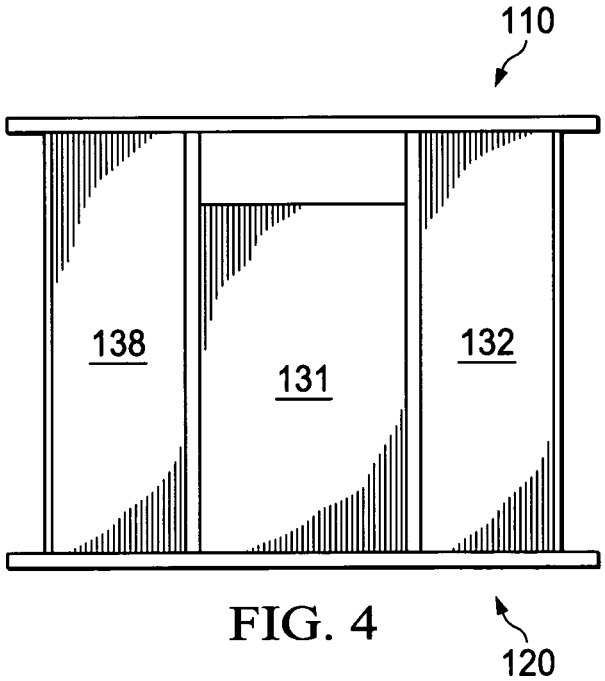
FIG. 4 is a top view of a regular octagonal housing for the rotary air collider mill.

Referring now to both FIGS. 3 and 4, a front elevation and a top view of a regular octagonal housing 100 formed of eight side plates 131-138 is shown. As best viewed in FIG. 4, the uppermost plate 131 is cut about 20 by 20 inches square to allow about a 4.5 inch wide opening to vent crushed rock powder upward into the exhaust chamber and out of the exhaust port, not shown. The other seven side plates 132-138 are cut about 20 inches long by about 24.5 inches wide. As best viewed in FIG. 3, the eight side plates are welded together at about 45 degree angles to form a regular octagonal housing 100.

Figure 5:
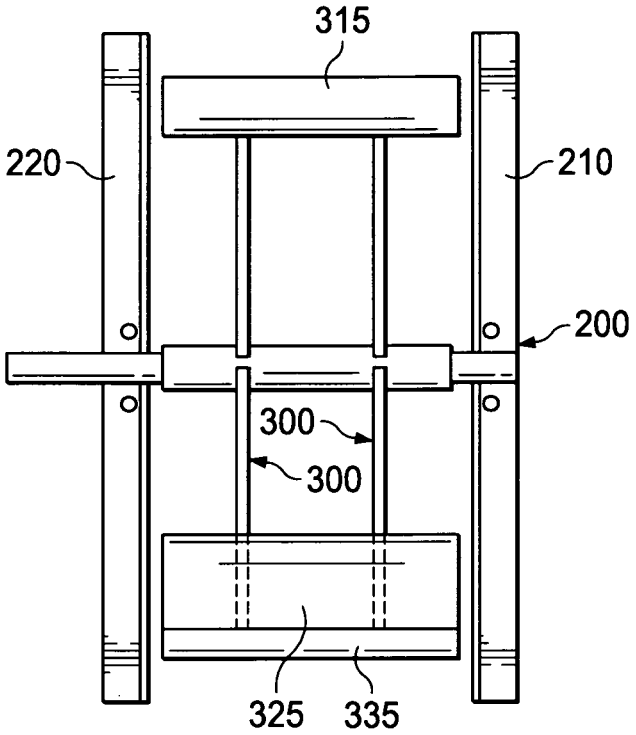
FIG. 5 is a left side detail view showing the assembled configuration of the drive shaft, sprocket and blades for the rotary air collider mill.

Referring now to FIG. 5 and also referring back to FIG. 2, the next component of the rotary collider air mill is the drive shaft 200 which is a solid steel bar of about 3¾ inches in diameter to allow a clearance of about ⅛ inch completely around the drive shaft 200 as it passes through the front plate 110 and the back plate 120 of the mill. As shown here, the drive shaft 200 extends horizontally through and perpendicular to the front plate 110 and the back plate 120 of the mill. The drive shaft 200 may be mounted through the front plate 110 and the back plate 120 of the mill with bearing supports 210, 220 or bushings, not shown, to ensure that it is allowed to rotate freely while not impinging upon the plates 110, 120 and causing undue wear.

The drive shaft 200 is connected to a drive motor, not shown, which may be a gas, diesel or electric power source which is then connected to the drive shaft 200 by means of belts, gears or other transmissions to permit the drive shaft 200 to rotate at various speeds, as needed. The drive motor or power source is not specified with particularity here because it may take many different forms and may be rated at various levels of horsepower (hp) which need only to be sufficient to drive the apparatus at the desired number of revolutions per minute (rpm). By way of example only, a rotary collider air mill of 48 inches in diameter will typically operate at about 100 to about 5000 revolutions per minute. This type of operation would usually require a motor having a power rating of approximately 10 to 250 horsepower. By way of example only, a 125 horsepower motor turning at about 4800 rpm could produce blade speeds reaching about 660 miles per hour on a 48 inch diameter model.

Figure 6:
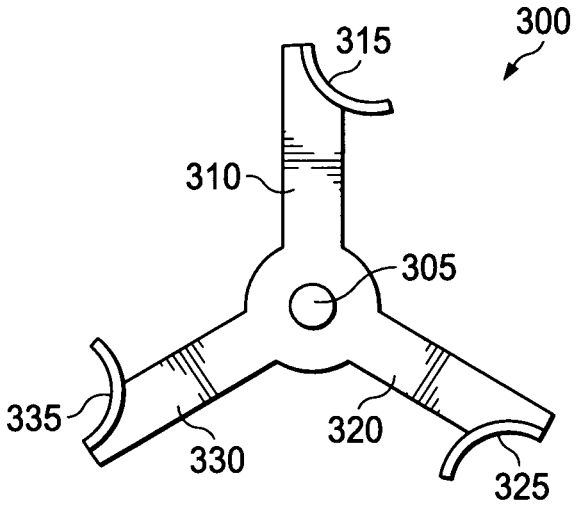
FIG. 6 is front detail view of a sprocket with three attached blades for the rotary air collider mill.

Referring now to FIG. 6 and referring back to FIG. 5, a sprocket 300 is welded or fixedly attached to the drive shaft 200. The sprocket 300, as shown here, features a 3 bladed design, but it is to be understood that the rotary collider air mill of the present invention may have more than 3 blades and that 5, 6, 8 or more blades in various embodiments that have also been contemplated. The 3 bladed design is shown in FIG. 6 as it is known to be well balanced and to efficiently mill rocks and minerals. Designs featuring more blades will need to be balanced and calibrated accordingly before use.

Still referring to FIGS. 5 and 6, the sprocket is shown having 3 pairs of parallel arms 310, 320, 330, each pair of arms supporting one of the 3 blades 315, 325, 335 that are each rotated through the air to create a very high speed chaotic airflow. This chaotic airflow, in turn, causes the input materials to be circulated about the interior of the polygonal housing 100 and to collide with each other. As shown in FIG. 6, the blades 315, 325, 335 are formed from three equal sections of steel pipe or tubing. For the 48 inch diameter model of the rotary collider air mill, a steel pipe having a nominal 6.75 inches exterior radius and a nominal 6.00 inches interior radius and a nominal wall thickness of about 0.75 inches. The pipe is to be cut into 3 equal 120 degree arcuate blade sections. The pipe, not shown, should have a length of about 24.0 inches. The resulting 120 degree arcuate blade sections 315, 325, 335 will be about 24.0 inches in width and will allow a clearance of about 0.25 inches on either side of the blades 315, 325, 335 from the front plate 110 and the back plate 120 of the mill.

As shown here, each arcuate blade section 315, 325, 335 is mounted on a pair of parallel arms 310, 320, 330 that extend radially outward from the hub 305 or central portion of the sprocket 300. Although a pair of parallel arms are shown here, it is to be understood that each arcuate blade section 315, 325, 335 may be attached to the sprocket 300 by one arm, two arms, three arms or more. The arcuate blade section 315, 325, 335 may be mounted or welded to the pair of arms 310, 320, 330 at any angle ranging from about 0 to 60 degrees (half of 120 degrees) to alter or adjust the angle of attack with which the leading edge of the blade will meet the air inside the polygonal housing 100. The angle at which the blade is mounted to the arms not only determines the angle of attack with the air within the housing but also helps to define the displacement of the blade. As noted earlier, the displacement of the blade is the difference between the outermost radius swept by the rotating blade and the innermost radius swept by the rotating blade. As shown in FIG. 6, the displacement of the blades is about 6 inches.

The displacement will be minimized when the blade is mounted at 0 degrees and will be maximized when the blade is mounted at 60 degrees. Accordingly, the more the blade is rotated to cup or catch the oncoming air, the greater the displacement of the blade. It is notable that the largest blade displacement is not always the most desirable configuration in when the air mill is in operation. In some cases, it may be desirable to reduce the displacement of the blades to increase the residence time of the input materials within the housing. Input materials which remain in the housing for longer periods of time will usually experience more collisions and produce smaller output particle sizes.

Figure 7:
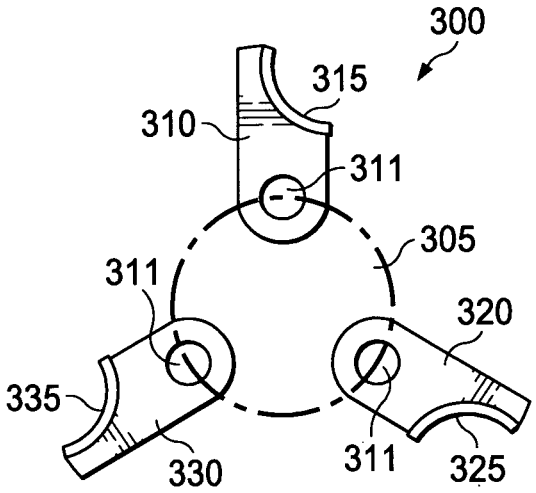
FIG. 7 is a front conceptual view of a sprocket having a central hub and three detachable arm and blade units.
Figure 8:
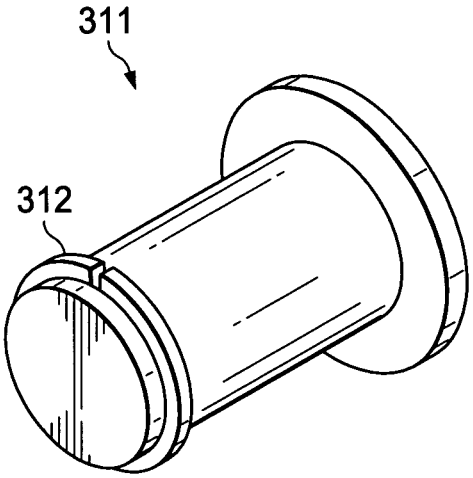
FIG. 8 is a detailed perspective view of a pin and retaining clip used to secure the detachable arm and blade units to the central hub.

Referring now to FIGS. 7 and 8, in one alternative embodiment of the rotary collider air mill in accordance with the present invention, each pair of parallel arms 310, 320, 330 that are welded to and support the arcuate blade section 315, 325, 335 may be attached to the central hub 305 portion of the sprocket 300 by removable pins 311. Each of the removable pins 311 is held in place by a thin metal retaining clip 312. The retaining clip 312 is fitted into a groove located near the tapered end of the pin 311. Alternatively, cotter pins (not shown) or some other retention means may also be used to hold the removable pins 311 in place and to keep the parallel arms 310, 320, 330 and attached blades 315, 325, 335 firmly attached to the hub 305 of the sprocket 300.

The removable parallel arm and blade units would be particularly useful if one of the attached blade sections were to become severely damaged and in need of replacement. In this way, it would be possible to replace a just single blade section by removing two retaining pins rather than having to replace the entire sprocket and all of the attached blade sections at once. This alternative embodiment would also permit air mill operators to switch out the parallel arm and blade units to change the angle or the shape of the blades. Although the blade sections illustrated herein are three 120 degree arcuate portions that are formed from a single steel pipe, it is to be understood that the blade sections may have different thickness, radius of curvature or even be somewhat flattened out, if desired.

Another alternative embodiment of the present invention is contemplated by having a sprocket with welded or fixed arms and having removable blades attached to the arms by a number of small removable pins. In brief, rather than removing the entire arm and blade units as shown in FIGS.

7 and 8, it is possible to remove the blades only by attaching them to the arms with a number of small pins, not shown. By way of example only, the blades may have a C-shaped mount on the underside which fits over the outmost end of the arms. A number of small pins may be inserted through holes in the mount and pass in a perpendicular direction through the arm. It is believed that in some applications it may be desirable to replace the blade sections either due to wear or simply to change the angle at which the blade is mounted to the arms. It is further believed that it may be easier to access and replace the blades alone than the entire arm and blade units.

While a number of preferred embodiments of the invention have been shown and described herein, modifications may be made by one skilled in the art without departing from the spirit and the teachings of the invention. The embodiments described herein are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What is claimed is:

1. A rotary collider air mill apparatus comprising:

a polygonal housing having a front plate and a back plate and 5 or more side plates;

a horizontal drive shaft passing through the central portion of said polygonal housing;

a sprocket mounted on said horizontal drive shaft and having arms extending radially from a central hub;

3 or more blade sections attached to said arms;

wherein the sprocket may be rotated by the horizontal drive shaft inside the polygonal housing, thereby moving the 3 or more blade sections to create a chaotic air flow within said polygonal housing; and wherein said 3 or more blade sections may achieve an air velocity of greater than about 600 miles per hour.

2. The apparatus according to claim 1, wherein said front plate further comprises an input port and an exhaust port.

3. The apparatus according to claim 2, wherein the rotation of said sprocket and the attached arms and blades creates a negative air pressure at the input port.

4. The apparatus according to claim 2, wherein the rotation of said sprocket and the attached arms and blades creates a positive air pressure at the exhaust port.

5. The apparatus according to claim 4, further comprising an exhaust chamber adjacent to and in fluid communication with said polygonal housing.

6. The apparatus according to claim 1, wherein each of said arms extending from said sprocket are attached to the sprocket by means of a removable pin.

7. The apparatus according to claim 6, wherein said removable pin is grooved to accommodate a retaining clip.

8. The apparatus according to claim 1, wherein each of the 3 or more blade sections may be mounted to the arms at an angle of about 0 to about 60 degrees.

9. The apparatus according to claim 1, wherein each of the 3 or more blade sections are attached to the arms by a C-shaped mounting and a number of removable pins.

10. The apparatus according to claim 1, wherein said polygonal housing, drive shaft, sprocket and blade sections are proportional and completely scalable from about 12 inches in diameter to about 144 inches in diameter.

11. A rotary collider air mill apparatus comprising:

a polygonal housing having a front plate and a back plate and 8 or more side plates;

a horizontal drive shaft passing through the central portion of said polygonal housing;

a sprocket mounted on said horizontal drive shaft and having arms extending radially from a central hub;

3 or more arcuate blade sections attached to said arms;

wherein the sprocket may be rotated by the horizontal drive shaft inside the polygonal housing, thereby moving the 3 or more arcuate blade sections to create a chaotic air flow within said polygonal housing; and wherein said 3 or more arcuate blade sections may achieve an air velocity of greater than about 600 miles per hour.

12. The apparatus according to claim 11, wherein said front plate further comprises an input port and an exhaust port.

13. The apparatus according to claim 11, wherein said 8 or more side plates are cut in equal lengths to form a regular polygon.

14. The apparatus according to claim 11, wherein the 3 or more arcuate blade sections further comprise a C-shaped mounting for attachment to said arms.

15. The apparatus according to claim 14, wherein the 3 or more arcuate blade sections are attached to said arms by a number of removable pins.

* * * * *